US008280576B2

(12) United States Patent
Baeuerle et al.

(10) Patent No.: US 8,280,576 B2
(45) Date of Patent: Oct. 2, 2012

(54) METHOD FOR OPERATING AN AUTOMOTIVE DRIVE

(75) Inventors: Michael Baeuerle, Ditzingen-Heimerdingen (DE); Udo Sieber, Bietigheim (DE); Klaus Ries-Mueller, Bad Rappenau (DE)

(73) Assignee: Robert Bosch GmbH, Stuttgart (DE)

( * ) Notice: Subject to any disclaimer, the term of this patent is extended or adjusted under 35 U.S.C. 154(b) by 1102 days.

(21) Appl. No.: 12/069,742

(22) Filed: Feb. 12, 2008

(65) Prior Publication Data

US 2008/0201046 A1 Aug. 21, 2008

(30) Foreign Application Priority Data

Feb. 13, 2007 (DE) ..... 10 2007 006 935

(51) Int. Cl.
*G01M 17/00* (2006.01)

(52) U.S. Cl. ..... 701/29.1; 701/31.1

(58) Field of Classification Search ..... 701/29, 701/31, 29.1, 31.1
See application file for complete search history.

(56) References Cited

U.S. PATENT DOCUMENTS

| | | | | |
|---|---|---|---|---|
| 5,461,289 | A * | 10/1995 | Adler et al. | 318/139 |
| 5,813,940 | A * | 9/1998 | Ramm et al. | 477/93 |
| 7,189,171 | B2 * | 3/2007 | Takemura et al. | 474/8 |
| 7,430,865 | B2 * | 10/2008 | Filippone | 60/618 |
| 2001/0046921 | A1 * | 11/2001 | Imanishi et al. | 476/40 |
| 2003/0172883 | A1 * | 9/2003 | Shiozaki et al. | 123/41.12 |
| 2004/0164560 | A1 * | 8/2004 | Odahara et al. | 290/40 C |
| 2006/0180123 | A1 * | 8/2006 | Bratvold et al. | 123/372 |

FOREIGN PATENT DOCUMENTS

| | | |
|---|---|---|
| DE | 196 17 839 | 11/1997 |
| DE | 10 2004 002 141 | 8/2005 |

* cited by examiner

*Primary Examiner* — Hussein A. Elchanti
(74) *Attorney, Agent, or Firm* — Kenyon & Kenyon LLP

(57) ABSTRACT

In an automotive drive, at least one dynamic characteristic of a bearing by which the automotive drive is supported on a beam is selectively influenced during operation of the automotive drive (active bearing). It is provided that a change in an instantaneous operating variable of the automotive drive is determined from a change in a state variable of the active bearing that influences its dynamic characteristic.

16 Claims, 4 Drawing Sheets

METHOD FOR OPERATING AN AUTOMOTIVE DRIVE

BACKGROUND INFORMATION

German Patent Application No. DE 10 2004 002 141 describes an automotive drive having a piston combustion engine, which is supported on a beam of the motor vehicle via a multitude of force-measuring bolts. Using the signals from the force-measuring bolts and taking specific geometric variables of the internal combustion engine into account, an instantaneous torque is determined. This torque can be used, for instance, to detect combustion misses.

German Patent Application No. DE 196 17 839 describes an active twin-chamber engine bearing, which makes it possible to set the damping of the suspension of the internal combustion engine as a function of the operating point. During idling operation of the internal combustion engine, for example, the damping is able to be reduced so that fewer vibrations are transmitted to the body shell. The known active twin-chamber engine bearing includes two chambers,-which are interconnected via a channel and filled with an electrorheological fluid. The flow characteristic of the fluid between the two chambers, and thus the damping behavior of the bearing, is controllable by varying the viscosity. Also known are controllable active engine bearings that enclose a volume whose content is variable with the aid of a valve control system.

SUMMARY OF THE INVENTION

It is an object of the present invention to provide a method for operating an automotive drive having an active bearing, which improves the operating safety and the operating comfort of the automotive drive at low expense.

This object is achieved by a method according to the present invention and by a control and/or regulating device according to the present invention.

One advantage of the method according to the present invention is that a sensor system, which is generally provided in an active bearing anyway and which detects a state variable of the bearing, may be utilized to determine a change in the instantaneous operating variable of the automotive drive. Additional hardware such as a force-measuring bolt, as in the related art, is not required. This is based on the finding according to the present invention that in many cases no absolute value of an instantaneous operating variable of the automotive drive has to be determined, but that a relative change of the instantaneous operating variable will suffice already. Knowledge of the change in the instantaneous operating variable permits a multitude of diagnoses of components of the automotive drive, especially in those instances where the instantaneous operating variable involves an instantaneous torque.

It is especially advantageous if the change in the instantaneous operating variable is determined on the basis of the change in the state variable of the active bearing only if there is a change in an actuating variable of the automotive drive that affects the instantaneous operating variable. This may increase the certainty that a change in the state variable of the active bearing is related to the change in the instantaneous operating variable of the automotive drive rather than being caused by other influences.

This is true in particular when the actuating variable is a driver-desired torque, a setting of the driving pedal, a gear ratio, a number of active cylinders, a combustion method or a fuel type. The instantaneous operating variable of the automotive drive such as the instantaneous torque would thus be determined only if there is a change in one of these actuating variables. If the actuating variable is the driver-desired torque or the setting of a driving pedal, then the desired and the actual change in the instantaneous torque may be checked or diagnosed with the aid of the method according to the present invention. If the actuating variable is a gear ratio, then the shifting comfort is able to be determined. The objective is to control the shifting operation (in an automatic transmission) in such a way that the changes in the state variable of the active bearing are kept to a minimum.

The number of active cylinders plays a role in what is commonly known as "half-engine operation", i.e., a cylinder deactivation. This is employed in certain internal combustion engines in an operation in the part throttle range. For example, one half of the cylinders in an eight-cylinder engine is deactivated, which leads to vibrations of the internal combustion engine or the automotive drive, which are able to be reduced to a minimum with the aid of the present invention.

Using the method according to the present invention, it is also possible to specify a transition comfort when changing from one combustion method to another combustion method, e.g., from stratified combustion to homogenous combustion. In the same way it is possible to specify the transition comfort when changing from one type of fuel, such as gasoline, to another type of fuel, such as gas. The individual change should be controlled in such a way that no changes in the instantaneous torque arise during the transition. The method of the present invention is also able to optimize the selected combustion method with regard to smooth running, that is to say, the combustion method is adaptable to a changing fuel composition. With the aid of the method according to the present invention, it is also possible to detect combustion misses by an irregular running evaluation.

To improve the meaningfulness of the method according to the present invention, it is advantageous if at least one interference variable is taken into account when determining the change in the instantaneous operating variable. Such an interference variable may involve, for instance, a change in the state variable of the active bearing imposed via the drive train. Such interferences may occur when traveling on a rough road surface or they may arise in an automatic braking intervention (ESP). Such an interference variable is easily determinable from a change in the rotational speed of a wheel of the automotive drive.

Another advantageous development of the method according to the present invention provides that the determined change in the instantaneous operating variable be used to optimize an actuating variable of the automotive drive. Such an actuating variable may be, for instance, an injection quantity, an injection instant, etc. Such an actuating variable generally influences the instantaneous torque of the internal combustion engine or the automotive drive and thereby, in turn, ultimately the comfort in a change of the instantaneous operating variable.

This is especially advantageous, however, if the actuating variable acts on a starter of the automotive drive. In this way the starting of the internal combustion engine of the automotive drive is able to be optimized. This is based on the observation that in a start-stop operation, for example, a comfortable start of the internal combustion engine is especially important. This means that the vibrations during the startup of the internal combustion engine should be kept to a minimum. The method of the present invention allows a power control of the starter, by which the output is controlled as a function of the change in the state variable of the active bearing.

Furthermore, using the method according to the present invention, the determined change in the state variable of the active bearing may be utilized to detect engine damage, in particular damage to a bearing of a crankshaft, or—as mentioned previously already—to detect combustion misses.

The method of the present invention functions in an especially uncomplicated manner if the state variable encompasses a pressure in a hydraulic or pneumatic volume of the active bearing. For in a torque change, e.g., an acceleration operation, the internal combustion engine or the automotive drive rotates, and a tensile or pressure load is imposed on the bearing. This load or load change is detectable by the mentioned pressure measurement.

DETAILED DESCRIPTION

Figure 1:
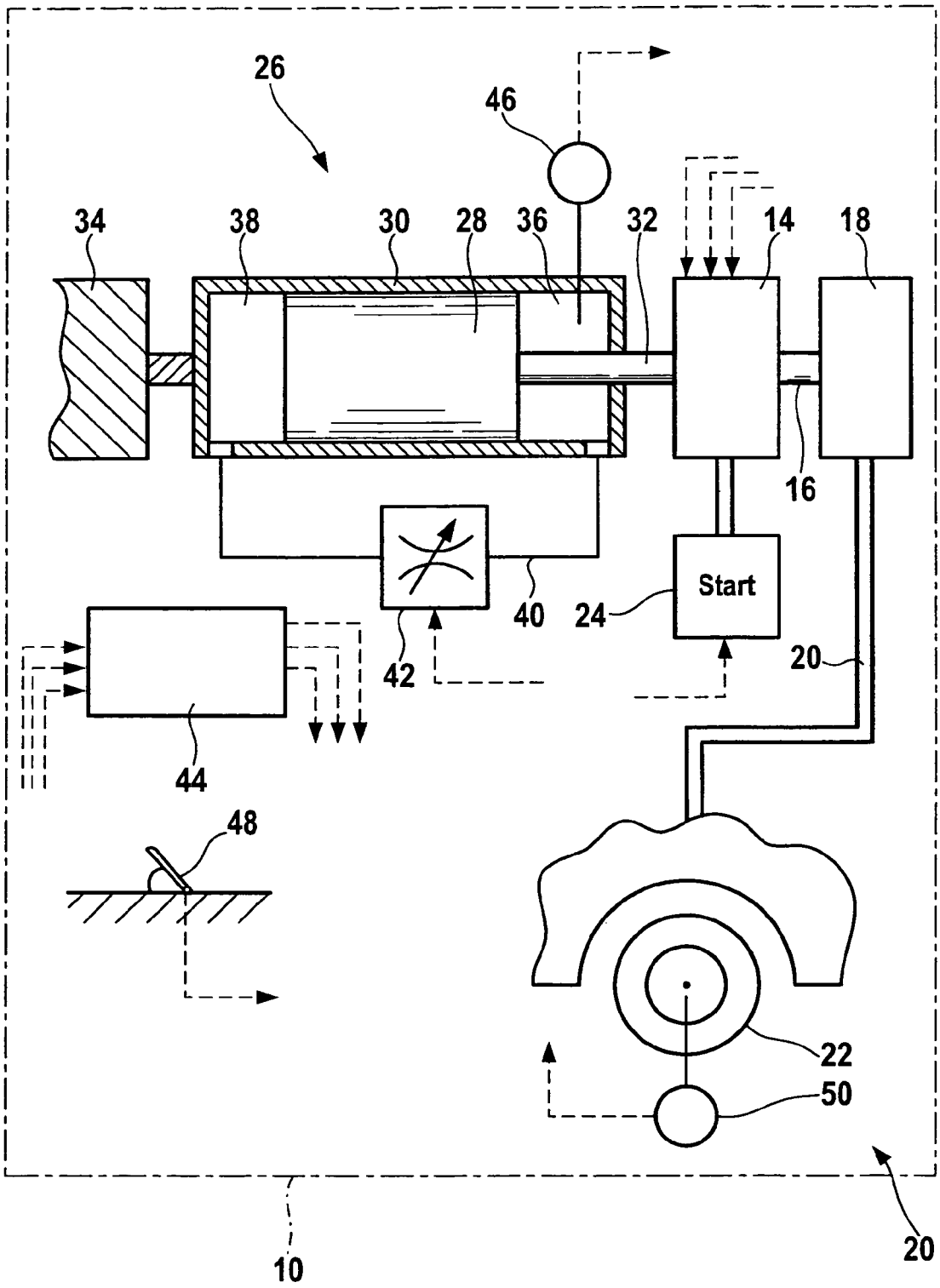
FIG. 1 shows a schematic representation of a motor vehicle having an automotive drive and having an active bearing, which supports the automotive drive on a beam.

An entire motor vehicle is denoted by reference numeral 10 in FIG. 1. It is sketched merely symbolically by a box outlined by a dot-dash line. An automotive drive 12 is part of motor vehicle 10.

Automotive drive 12 includes a piston combustion engine 14, which drives an automatic transmission 18 via a crankshaft 16. The automatic transmission is in turn connected to at least one wheel 22 via a drive shaft 20. A starter 24 starts internal combustion engine 14.

Internal combustion engine 14 and transmission 18 are mounted on a beam 34 of motor vehicle 10 via a plurality of active engine bearings. Only one of the active engine bearings is shown in FIG. 1 and denoted by reference numeral 26. Active engine bearing 26 includes a piston 28, which is guided inside a cylinder 30. With the aid of a piston rod 32, piston 28 is connected to internal combustion engine 14. Cylinder 30, on the other hand, is rigidly connected to beam 34, which in turn is attached to motor vehicle 10. In the direction of internal combustion engine 14, a first pneumatic volume 36 is formed between piston 28 and cylinder 30, while a second pneumatic volume 38 is formed between the other side of piston 28 and cylinder 30, i.e., in the direction of beam 34. Both volumes 36 and 38 are filled with air and interconnected via a line 40. An adjustable throttle 42 is disposed inside the line.

The operation of motor vehicle 10 and automotive drive 12 is controlled or regulated by a control and/or regulating device 44. It receives signals from various sensors such as, for instance, a pressure sensor 46, which detects the pressure in first pneumatic volume 36 of active engine bearing 26. Furthermore, control and regulating device 44 receives signals from a sensor (not shown) of a driving pedal 48, which is activatable by an operator of motor vehicle 10. A rotational speed of wheel 22 is recorded by a wheel sensor 50 and likewise transmitted to control and regulating device 44. Control and regulating device 44 triggers, among others, internal combustion engine 14, in this case, injectors, for instance, which are not shown, and/or a likewise not shown throttle valve, as well as starter 24 and throttle 42.

Active engine bearing 26 makes it possible to adjust the damping of the bearing of internal combustion engine 14 or transmission 18 as a function of an operating point. During idling operation of internal combustion engine 14, for example, the damping may be reduced by opening throttle 42, so that fewer vibrations are transmitted from internal combustion engine 14 to the body shell (not shown) of motor vehicle 10.

Active engine bearing 26 may be regulated in the process. The pressure measurement with the aid of pressure sensor 46 is utilized for that purpose. The pressure prevailing in first pneumatic volume 36 measured by pressure sensor 46 thus is a state variable of active engine bearing 26 which influences its dynamic characteristic.

Normally, the signals from pressure sensor 46 are proportional to the vibration of internal combustion engine 14 with respect to beam 34. In an acceleration operation, internal combustion engine 14 twists and active engine bearing 26 is subjected to tensile or compressive loading, which results in a change in the signal detected by pressure sensor 46. This correlation is utilized in automotive drive 12 shown in FIG. 1 to determine a change in an instantaneous operating variable of automotive drive 12, such as an instantaneous torque, for example. A corresponding method is stored in a memory of control and regulating device 44 in the form of a computer program. The method will now be elucidated in detail with reference to FIGS. 2 through 4.

Following a start in 52, it is first checked in 54 whether a change is occurring in an actuating variable of automotive drive 12 that has an effect on the instantaneous torque of internal combustion engine 14 as instantaneous operating variable. Such an actuating variable may be, for instance, a position wped of driving pedal 48. A change in position wped of driving pedal 48 is denoted by dwped in FIG. 2. Additional changes of actuating variables that affect the instantaneous torque of internal combustion engine 14 are denoted in FIG. 2 by dfawu (change in driver-desired torque fawu), di (change in gear ratio i), dnzyl (change in number nzyl of the active cylinders), dmod (change in combustion method mod of internal combustion engine 14), and dfuel (change in fuel type fuel). If it is determined in 54 that one of the mentioned actuating variables is changing, then a change dM (block 58) of the instantaneous torque is determined in 56 on the basis of a pressure change dp recorded by pressure sensor 46. In 60, this change dM of the instantaneous torque is used to influence, i.e., optimize, the operation of internal combustion engine 14 in a manner still to be elucidated in more detail. The method ends in 62.

Figure 2:
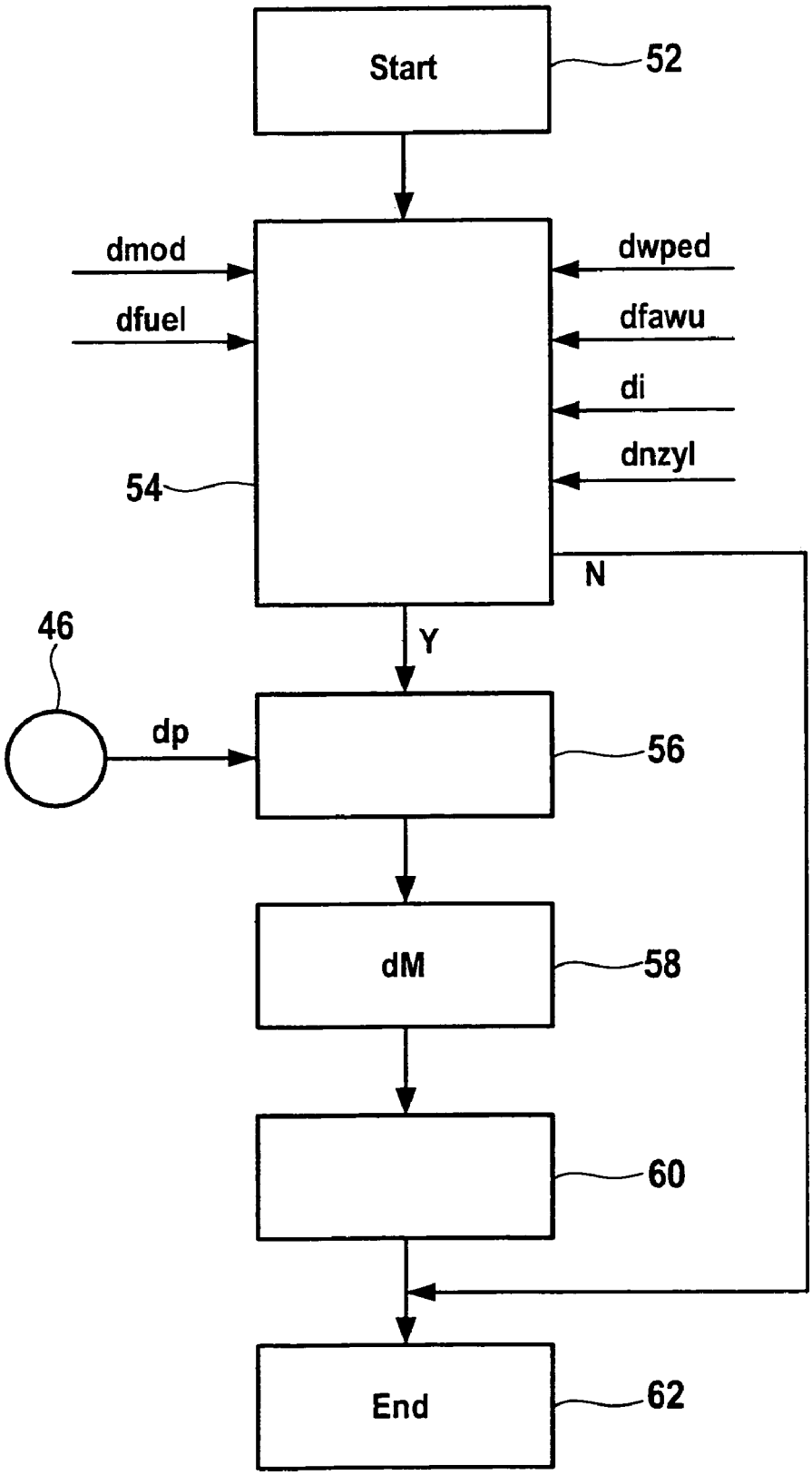
FIG. 2 shows a flow chart of a method for operating the automotive drive from FIG. 1.
Figure 3:
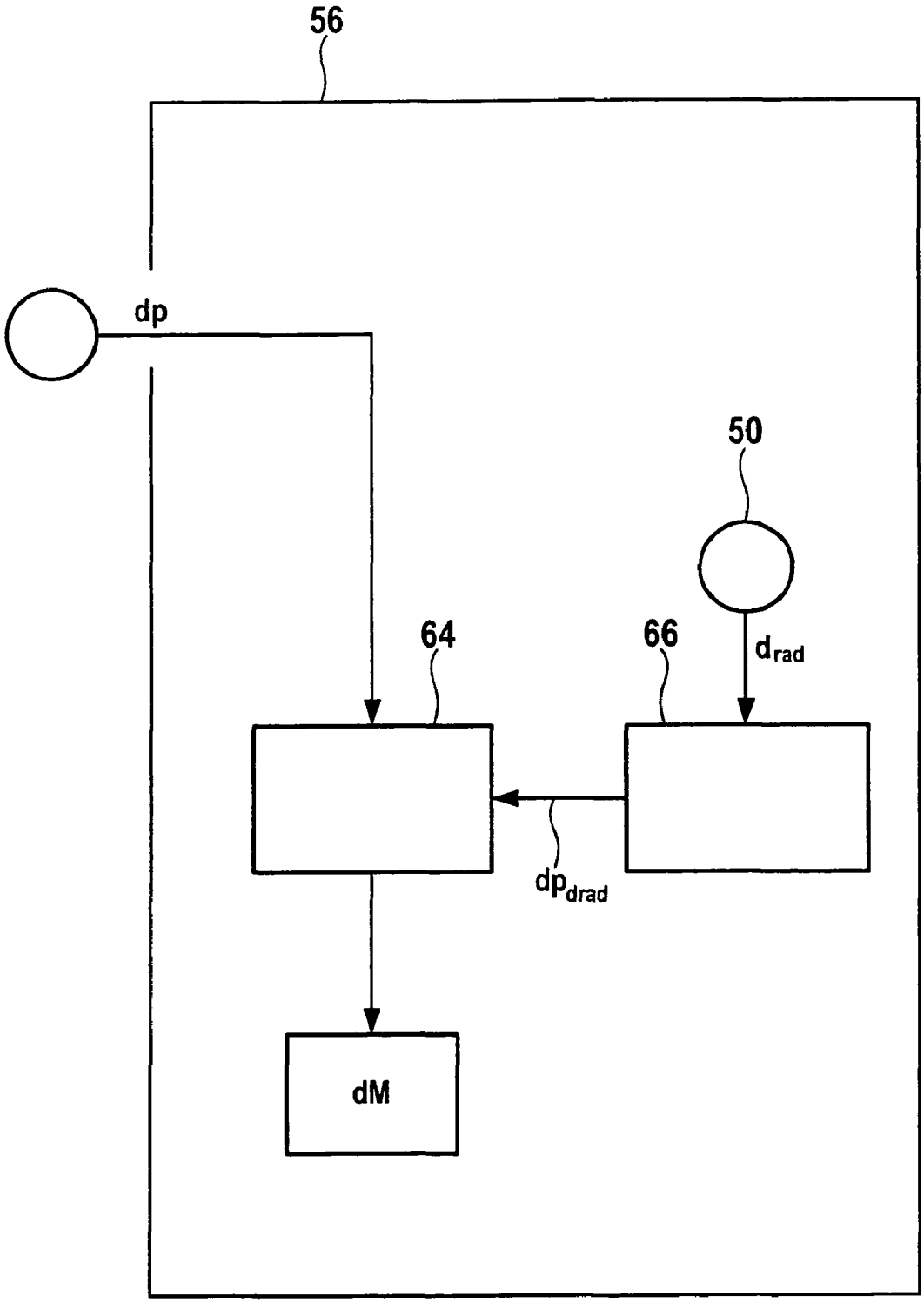
FIG. 3 shows a detail of the method from FIG. 2.

FIG. 3 shows block 56 from FIG. 2 in greater detail. According to this, pressure change dp of the pressure prevailing in first pneumatic volume 36 is subjected to an interference variable correction in 64. This takes into account that changes may occur in rotational speed drad of wheel 22, for instance when motor vehicle 10 is traveling on a road surface that is in very poor condition, e.g., is quite uneven; such changes in rotational speed act on internal combustion engine 14 via the drive train, i.e., drive shaft 20, transmission 18 and crankshaft 16, and ultimately impose a pressure change $dp_{drad}$ on active engine bearing 26. This correlation is represented by a numerical model in 66. In 64, pressure change dp detected by pressure sensor 46 is corrected by interference variable $dp_{drad}$, and then actual change dM of the instantaneous torque is determined.

Figure 4:
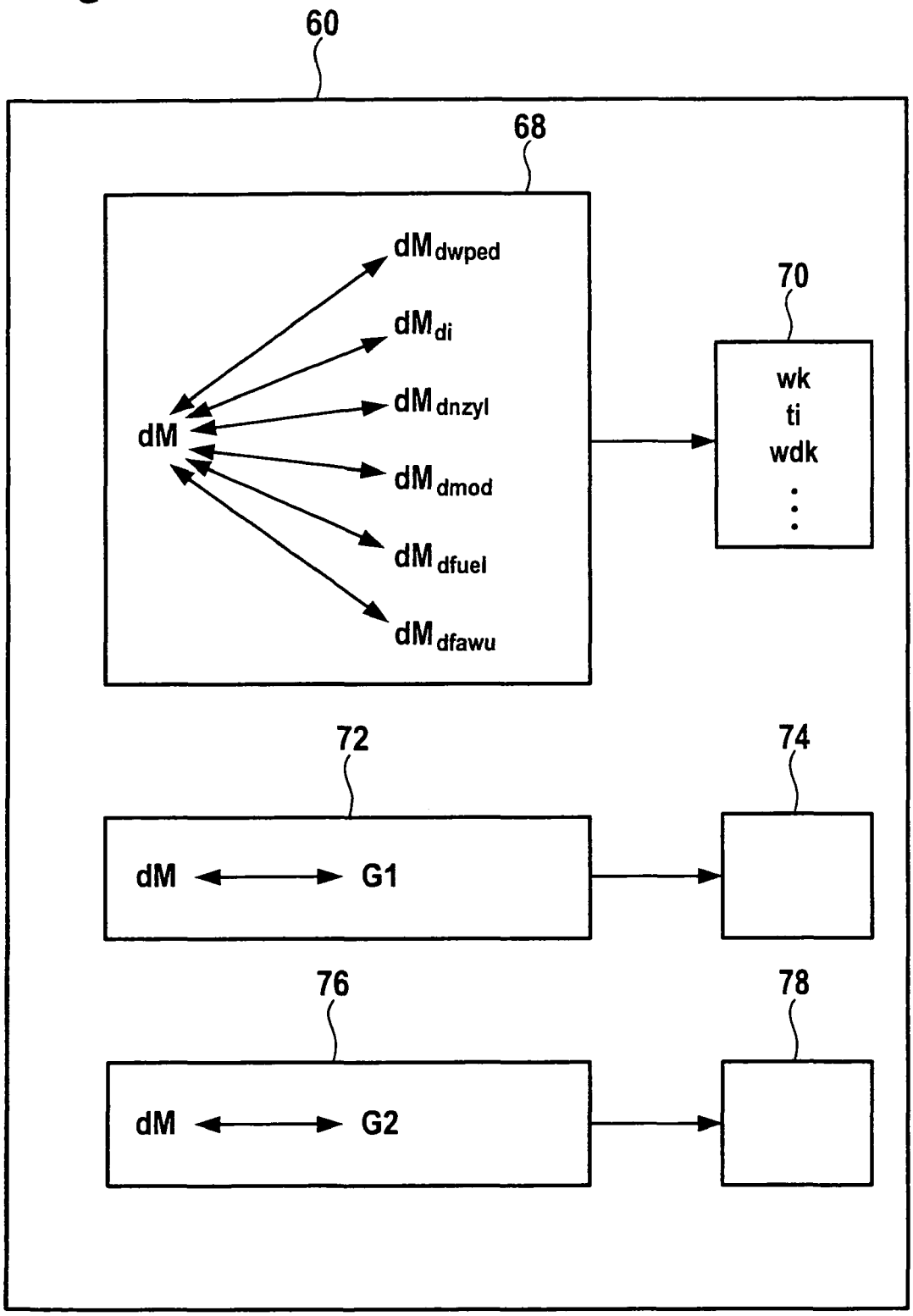
FIG. 4 shows another detail of the method from FIG. 2.

The utilization in 60 of change dM of the instantaneous torque determined on the basis of pressure change dp will now be elucidated in greater detail with reference to FIG. 4: Due to the query in 54, determined change dM is assignable to a change dwped, dfawu, di, dnzyl, dmod, or dfuel of a corresponding actuating variable of automotive drive 12. In 68, determined change dM is compared to an expected change $dM_{dwped}$, $dM_{dfawu}$, $dM_{di}$, $dM_{dnzyl}$, $dM_{dmod}$, and $dM_{dfuel}$, and a fuel quantity wk to be injected, an injection instant ti, a position of a throttle valve wdk, etc. is adapted accordingly in 70 as a function of the result of the comparison. The criterion for the adaptation is to ensure the greatest possible comfort for the user of motor vehicle 10. For example, in a change di of the gear ratio, in a change in the number dnzyl of the active cylinders, in a change dmod of the combustion method, or in a change dfuel of the fuel type used, the associated torque change dM should be as low as possible.

Furthermore, ascertained change dM is compared to a limit value G1 in 72. An increased irregular operation or the occurrence of combustion misses is detected (block 74) as a function of the result of the comparison. In 76, change dM of the instantaneous torque is compared to a limit value G2, and in 78, bearing damage, e.g., to a bearing of crankshaft 16, is detected as a function of the result of the comparison in 76.

What is claimed is:

1. A computer-implemented method for operating an automotive drive supported on a beam via an active engine bearing, the method comprising:

determining, by a computer processor, a change in an instantaneous operating variable of the automotive drive from a change in a state variable of the active engine bearing that influences a dynamic characteristic of the active engine bearing; and selectively influencing, by the processor, the dynamic characteristic based on the determined change in the instantaneous operating variable, wherein the selective influencing is performed responsive to a detection of a change in an actuating variable of the automotive drive that affects the instantaneous variable;

wherein the state variable includes a pressure in a hydraulic or pneumatic volume of the active engine bearing.

2. The method according to claim 1, wherein the instantaneous operating variable is an instantaneous torque.

3. The method according to claim 1, wherein the determining of the change in the instantaneous operating variable is performed conditional upon the detection of the change in the actuating variable of the automotive drive that affects the instantaneous operating variable.

4. The method according to claim 3, wherein the actuating variable is a driver-desired torque, a driving pedal position, a gear ratio, a number of active cylinders, a combustion method, or a fuel type.

5. The method according to claim 1, wherein at least one interference variable is taken into account when determining the change in the instantaneous operating variable.

6. The method according to claim 5, wherein the interference variable includes a change in the state variable of the active bearing imposed via a drive train.

7. The method according to claim 6, further comprising determining the interference variable from a change in a rotational speed of a wheel of the automotive drive.

8. The method according to claim 1, further comprising utilizing the determined change in the instantaneous operating variable to optimize an actuating variable of the automotive drive.

9. The method according to claim 8, wherein the actuating variable acts on a starter of the automotive drive.

10. The method according to claim 1, further comprising using the determined change in the state variable of the active bearing to detect at least one of (a) engine damage, including damage to a bearing of a crankshaft, and (b) combustion misses.

11. A control/regulating device for an automotive drive having stored thereon instructions executable by a processor, the instructions which, when executed by the processor, cause the processor to perform a method for operating an automotive drive supported on a beam via an active engine bearing, the method comprising:

determining a change in an instantaneous operating variable of the automotive drive from a change in a state variable of the active engine bearing that influences a dynamic characteristic of the active engine bearing; and selectively influencing, by the processor, the dynamic characteristic based on the determined change in the instantaneous operating variable, wherein the selective influencing is performed responsive to a detection of a change in an actuating variable of the automotive drive that affects the instantaneous variable;

wherein the state variable includes a pressure in a hydraulic or pneumatic volume of the active engine bearing.

12. The method according to claim 1, wherein the determining of the change in the instantaneous operating variable is performed responsive to the detection of the change in the actuating variable of the automotive drive that affects the instantaneous operating variable.

13. The method according to claim 1, further comprising:

comparing the determined change in the instantaneous operating variable to a change in the instantaneous operating variable that is expected based on the detected change in the actuating variable, wherein the selective influencing is based on a result of the comparison.

14. The method according to claim 1, wherein the state variable is a pressure of a volume between (a) a piston that is connected to an internal combustion engine and (b) cylinder housing the piston.

15. The method according to claim 1, wherein the actuating variable is at least one of a driving pedal position, indicated driver-desired torque, gear ratio, number of active cylinders, combustion method, and fuel type.

16. The method according claim 1, wherein the selective influencing is performed by modifying at least one of a fuel quantity to be injected, an injection instant, and a throttle valve position.

* * * * *